US007083429B2

(12) United States Patent
Hashimoto et al.

(10) Patent No.: US 7,083,429 B2
(45) Date of Patent: Aug. 1, 2006

(54) IC SOCKET

(75) Inventors: Shinichi Hashimoto, Kanagawa (JP); Hiroshi Shirai, Saitama (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 10/877,402

(22) Filed: Jun. 25, 2004

(65) Prior Publication Data

US 2004/0266246 A1 Dec. 30, 2004

(30) Foreign Application Priority Data

Jun. 27, 2003 (JP) ..... 2003-184257

(51) Int. Cl.
*H01R 12/00* (2006.01)

(52) U.S. Cl. ..... 439/71; 439/66

(58) Field of Classification Search ..... 439/71, 439/66, 73, 342

See application file for complete search history.

(56) References Cited

U.S. PATENT DOCUMENTS

| | | | | |
|---|---|---|---|---|
| 4,761,140 | A | 8/1988 | Geib | |
| 6,132,220 | A * | 10/2000 | McHugh et al. | 439/66 |
| 6,186,797 | B1 * | 2/2001 | Wang et al. | 439/66 |
| 6,293,806 | B1 * | 9/2001 | Yu | 439/66 |
| 6,561,819 | B1 * | 5/2003 | Huang et al. | 439/66 |
| 6,604,950 | B1 * | 8/2003 | Maldonado et al. | 439/66 |
| 6,626,683 | B1 * | 9/2003 | Lai | 439/73 |
| 6,638,078 | B1 * | 10/2003 | Hashiguchi et al. | 439/66 |
| 6,695,624 | B1 * | 2/2004 | Szu | 439/66 |
| 6,758,683 | B1 * | 7/2004 | Koopman et al. | 439/71 |
| 6,776,642 | B1 * | 8/2004 | McHugh et al. | 439/331 |
| 6,805,561 | B1 * | 10/2004 | Walkup et al. | 439/66 |
| 6,811,408 | B1 * | 11/2004 | Achammer et al. | 439/66 |
| 6,824,396 | B1 * | 11/2004 | Koopman et al. | 439/71 |
| 6,827,586 | B1 * | 12/2004 | Noda et al. | 439/71 |
| 6,887,114 | B1 * | 5/2005 | Liao | 439/862 |
| 6,905,377 | B1 * | 6/2005 | Murr | 439/862 |
| 6,908,313 | B1 * | 6/2005 | Walkup et al. | 439/66 |
| 6,914,192 | B1 * | 7/2005 | Ju | 174/94 R |
| 2002/0182901 | A1 * | 12/2002 | Koopman et al. | 439/71 |
| 2005/0014398 | A1 * | 1/2005 | Liao et al. | 439/71 |
| 2005/0042940 | A1 * | 2/2005 | Liao | 439/862 |
| 2005/0054218 | A1 * | 3/2005 | Liao et al. | 439/66 |

FOREIGN PATENT DOCUMENTS

| | | |
|---|---|---|
| JP | 5(1993)-90378 | 12/1993 |

* cited by examiner

*Primary Examiner*—Ross Gushi
(74) *Attorney, Agent, or Firm*—Barley Snyder LLC

(57) ABSTRACT

An IC socket includes an insulative housing having an IC package receiving recess, in which an IC package is received. Contacts are disposed within cavities, which are provided in the IC package receiving recess in a matrix arrangement. Each contact includes a base which is installed into a cavity, an upwardly extending contact arm, which is offset above a cavity and a downwardly extending terminal portion, for electrically connecting with a circuit board. The insulative housing includes first partition walls which are provided between rows of cavities adjacent to each other in the first direction and second partition walls which are provided between rows of cavities adjacent to each other in a second direction perpendicular to the first direction, the first partition walls having greater heights than those of the second partition walls.

9 Claims, 6 Drawing Sheets

8
40
42
44
46
48
50
52a
52b
52c
52d
54
56
58
60
62
64
68

IC SOCKET

FIELD OF THE INVENTION

The invention relates to an IC (integrated circuit) socket, on which an LGA (land grid array) or a BGA (ball grid array) package is mounted.

BACKGROUND OF THE INVENTION

BGA or LGA IC sockets commonly have a large number of electrical contacts (hereinafter, simply referred to as "contacts"), arranged in a matrix along a bottom surface of an IC package receiving recess for electrically connecting with an IC package.

An example of such an IC socket is known a burn in socket. One such burn in socket is disclosed in Japanese Unexamined Utility Model Publication No. 5(1993)-90378 (FIG. 2). The burn in socket comprises a large number of contacts, which are located within an IC package receiving recess and arranged in a matrix. The contacts comprise transition sections that extend diagonally in a stepwise manner. Contact sections are formed at the free ends of the transition sections. The contact sections protrude into and are exposed within the IC package receiving recess of a housing.

Another conventional IC socket is disclosed in U.S. Pat. No. 4,761,140 (FIG. 2 and FIG. 3). This IC socket comprises rectangular contacts, which are provided along the four inner walls of an IC package receiving recess. The edges of free ends of the contacts are housed in the contact cavities, and do not protrude into the IC package receiving recess.

In the burn in socket disclosed in Japanese Unexamined Utility Model Publication No. 5(1993)-90378, the contact sections of the contacts protrude upwardly within the IC package receiving recess. Therefore, external objects, such as fingers and the like, may strike the exposed contact sections during mounting or dismounting of an IC package to or from the IC socket. This is particularly problematic in applications where the burn in socket is utilized to diagnose a CPU (central processing unit) of the IC package because the mounting and dismounting of the IC package is generally performed manually. When a finger strikes the contact sections of the contacts, there is a risk that the contact sections will plastically deform, thereby causing poor electrical contact between them and the IC package, when the IC package is mounted.

In the IC socket of U.S. Pat. No. 4,761,140, deformation of the contacts is prevented, because the edges of the free ends of the contacts are not engaged by a finger, even if a finger strikes the contacts. However, the size of the cavities, for housing the contacts, is relatively large, thereby causing a problem that the contacts cannot be arranged in a high density.

SUMMARY OF THE INVENTION

The invention has been developed in view of the circumstances described above. It is an object of the invention to provide an IC socket having high density contacts while reducing the risk of plastic deformation of the contacts caused by external objects.

The IC socket of the present invention is an IC socket to be mounted on a circuit board. The socket has an insulative housing and a plurality of contact disposed therein. The insulative housing has a plurality of cavities arranged in a matrix within an IC package receiving recess, a plurality of electrical contacts, disposed in the plurality of cavities and fixing sections for fixing an IC package in the IC package receiving recess. First partition walls are provided in the housing between rows of cavities adjacent to each other in a first direction and second housing partition walls are provided between rows of cavities adjacent to each other in a second direction perpendicular to the first direction. The first partition walls have greater heights than those of the second partition walls. The electrical contacts each have a base which is installed within a cavity, a contact arm which extends in a first direction from the upper side of the base in an offset manner above an adjacent cavity for electrically contacting the IC package and a terminal portion which is provided at the lower side of the base for electrically connecting the electrical contact to the circuit board.

BRIEF DESCRIPTION OF THE DRAWINGS

The invention will now be described by way of example with reference to the accompanying figures of which.

DETAILED DESCRIPTION OF THE INVENTION

Figure 1:
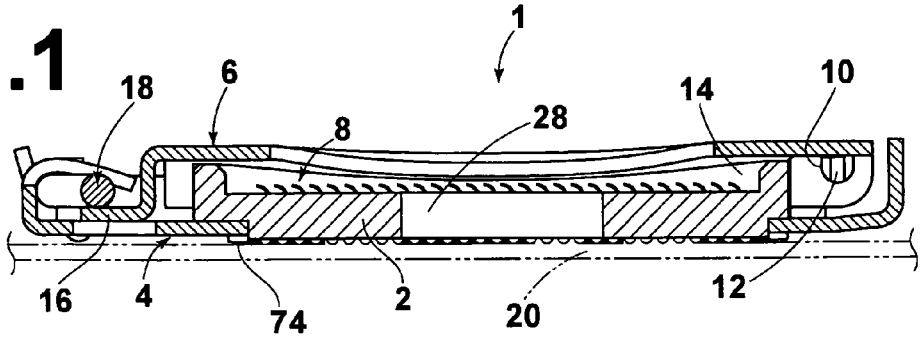
FIG. 1 is a sectional view of an IC socket according to the invention.

Hereinafter, a preferred embodiment of the invention will be described in detail with reference to the attached drawings. Referring first to FIG. 1, the IC socket 1 comprises an insulative housing 2 (hereinafter, simply referred to as "housing"), a metallic reinforcing plate 4, and a metallic cover member 6. The housing 2 is mountable on a circuit board 20. The reinforcing plate 4 is located at the bottom surface 74 of the housing 2. The cover member 6 is rotatably supported by the reinforcing plate 4.

An IC package receiving recess 14 is formed in the housing 2. A plurality of contacts 8 are located in the IC package receiving recess 14. The cover member 6, which covers the upper portion of the housing 2, is rotatably supported by a shaft 12 of the reinforcing plate 4 being inserted through bearings 10 of the cover member 6. An IC package 76 (refer to FIG. 7) is secured in the housing 2 by first pressing the cover member 6 downward so that the IC package 76 is urged against the contacts 8, then engaging a lever 18 with an engaging piece 16 at the foot of the cover member 6. The reinforcing plate 4, the cover member 6, and the lever 18 will collectively be referred to as a fixing mechanism. Note that the IC package 76 is omitted from FIG. 1. This construction is similar to that disclosed in Japanese Patent Application 2002-379635 (filed on Dec. 27, 2002).

Figure 2A:
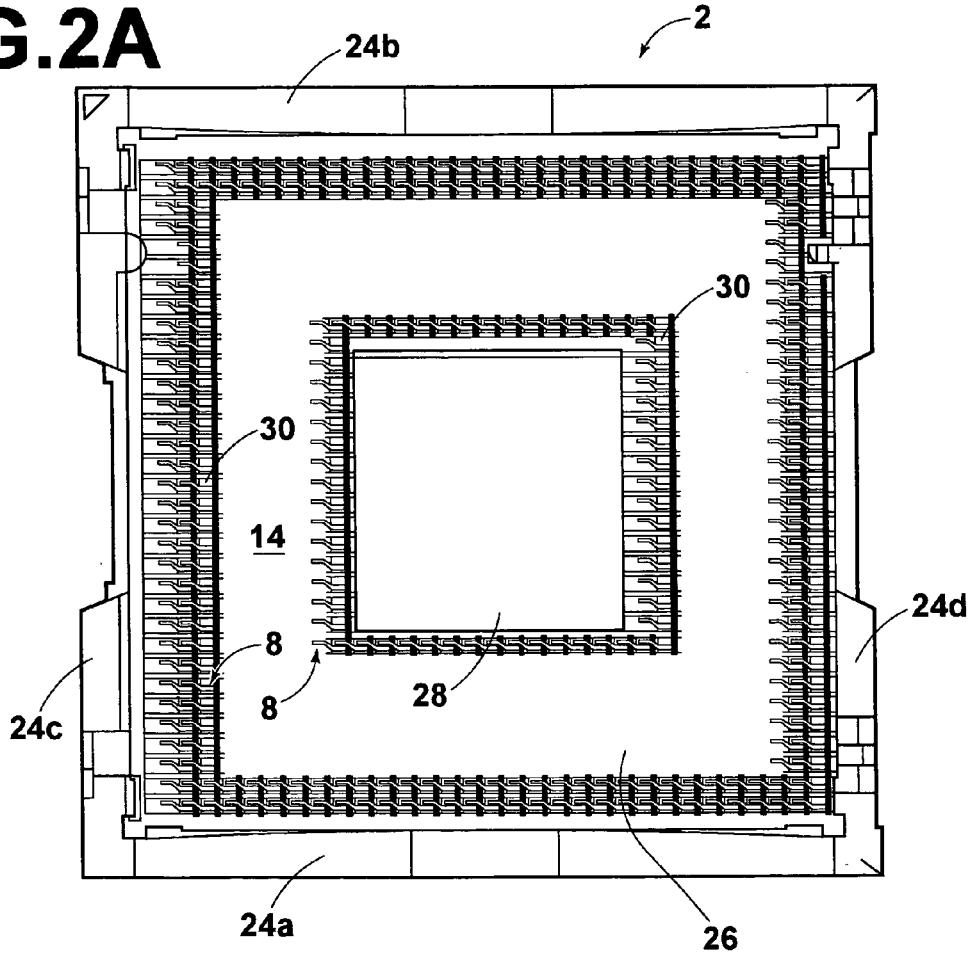
FIG. 2A is an enlarged plan view of an insulative housing of the IC socket illustrated in FIG. 1.
Figure 2B:
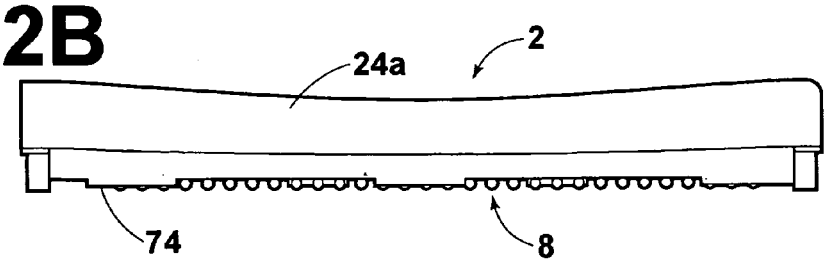
FIG. 2B is an enlarged front view of the insulative housing of the IC socket illustrated in FIG. 1.
Figure 3:
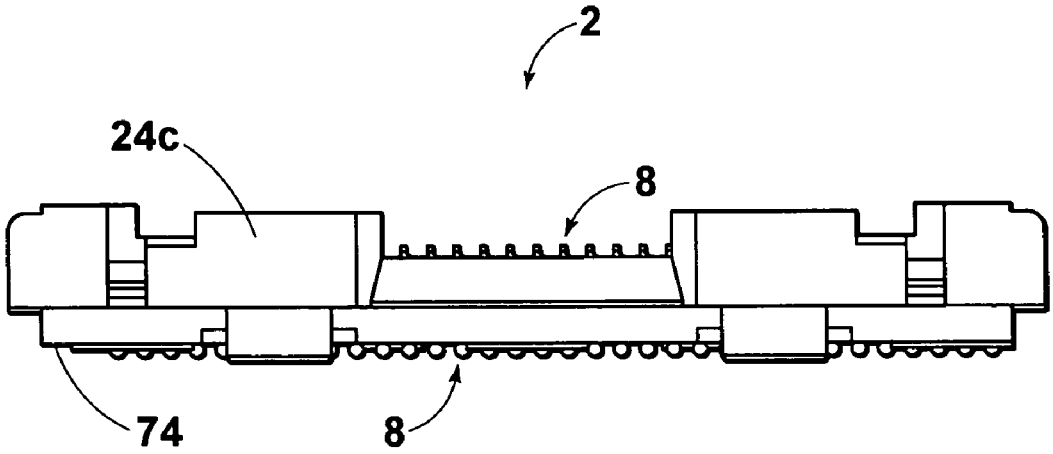
FIG. 3 is a left side view of the insulative housing illustrated in FIGS. 2A and 2B.
Figures 4A, 4B, 4C, 4D:
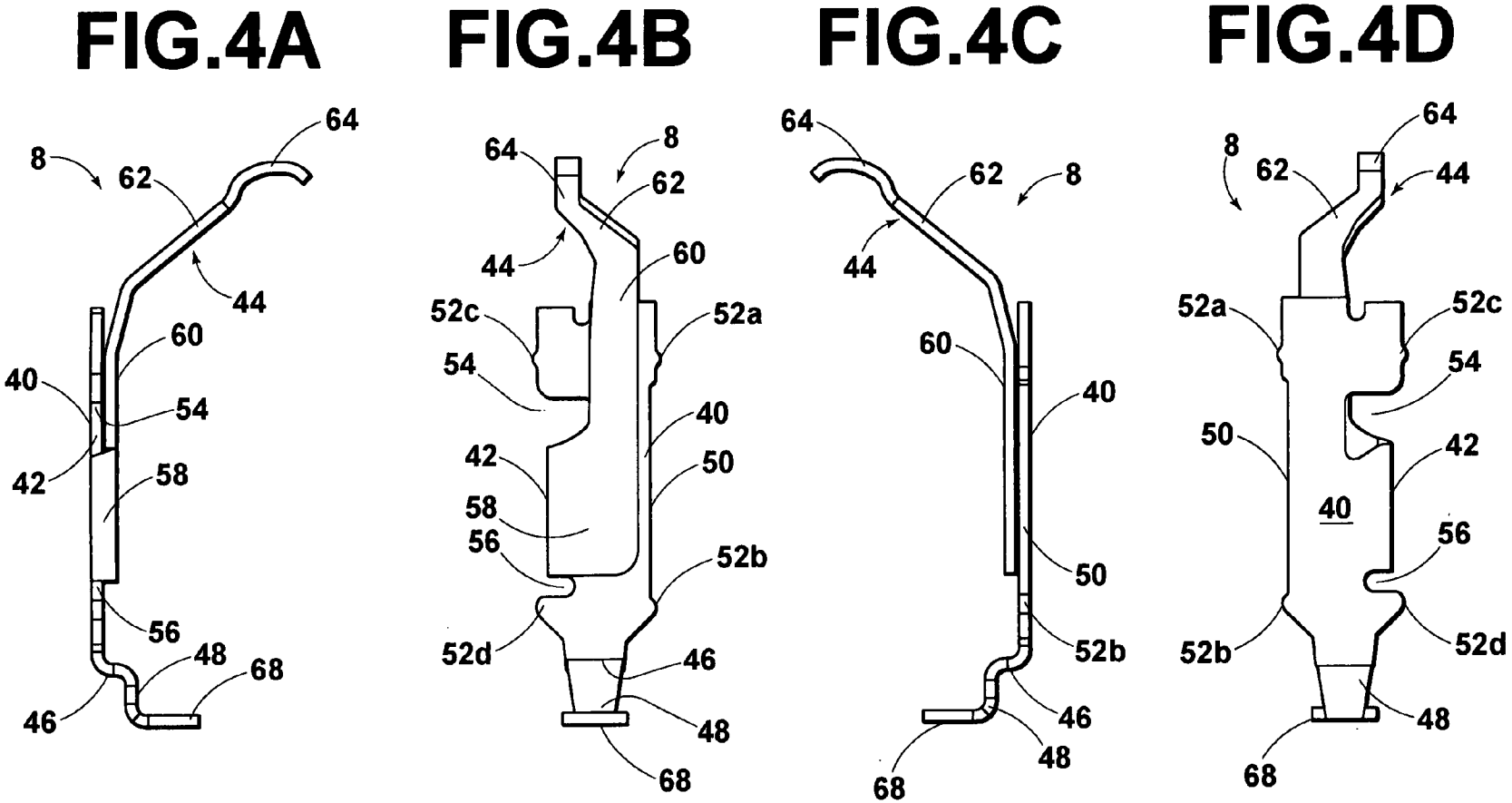
FIG. 4A is a rear view of an electrical contact, which is utilized in the IC socket of the invention.
FIG. 4B is a left side view of the electrical contact, which is utilized in the IC socket of the invention.
FIG. 4C is a front view of the electrical contact, which is utilized in the IC socket of the invention.
FIG. 4D is a right side view of the electrical contact, which is utilized in the IC socket of the invention.
Figure 5A:
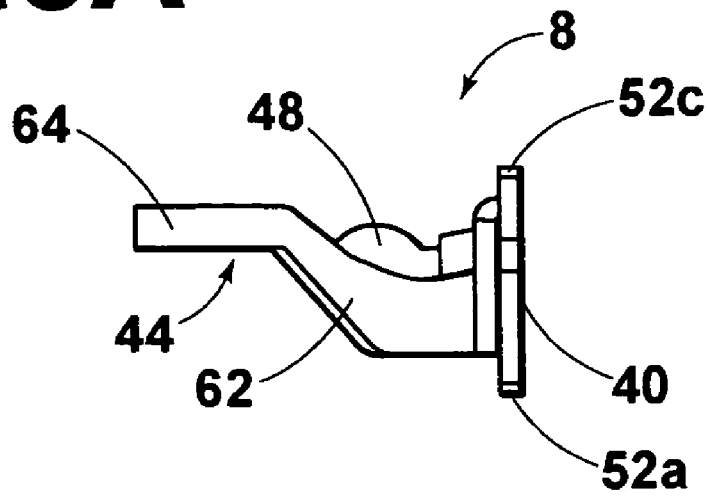
FIG. 5A is a plan view of the electrical contact illustrated in FIGS. 4A, 4B, 4C, and 4D.
Figure 5B:
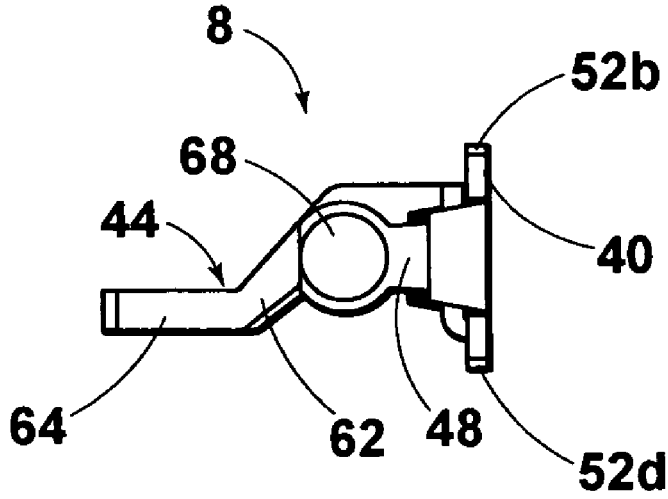
FIG. 5B is a bottom view of the electrical contact illustrated in FIGS. 4A, 4B, 4C, and 4D.

Next, the housing 2, which is utilized in the IC socket 1, will be described with reference to FIG. 2A, FIG. 2B, and FIG. 3. The housing 2 is generally rectangular and is molded from an insulative material. The IC package receiving recess 14 is also rectangular as defined by outer peripheral walls 24 (24*a*, 24*b*, 24*c*, and 24*d*). A rectangular opening 28 is formed in the bottom surface 26 of the IC package receiving recess 14. Contact receiving cavities 30 are formed and arranged in a matrix in the bottom surface 26 at regions around the opening 28. Note that in FIG. 2A, only a portion of the contact receiving cavities 30 and the contacts 8 are illustrated, and the rest are omitted. A respective contact 8 is housed in each cavity 30.

Next, the contacts 8 will be described with reference to FIGS. 4A, 4B, 4C, 4D, 5A, and 5B. The contact 8 comprises a base 40, a contact arm 44 and a terminal section 48. The base 40 is long in the vertical direction. The contact arm 44 is integrally bent from the base at a side edge 42 thereof. The terminal section 48 extends downward from the base 40 and is bent toward the same side as the contact arm 44 through a step portion 46.

Barbs 52 (52*a*, 52*b*, 52*c*, and 52*d*) are formed on the side edges 42 and 50 of the base 40 to engage the inner walls of a cavity 30 when the contact 8 is installed therein. The contact arm 44 comprises a bent back portion 58 which is bent back from the base 40, an extension portion 60 which extends upward from the bent back portion 58, an offset portion 62 which extends diagonally upward from the extension portion 60 and a free end 64 which curves and extends from the offset portion 62. The upper surface of the free end 64 is curved. The upper surface of the free end 64 is the electrical contact point between the contact 8 and the IC package 76. Cutouts 54 and 56 are formed in the side edge 42 of the base 40, to impart elasticity to the bent back portion 58 of the contact arm 44.

The foot 68 of the terminal section 48 is formed as a recessed circular member. A solder ball 66 (refer to FIG. 6A), for connecting with the circuit board 20 is attached to the lower surface of the foot 68.

Figure 6A:
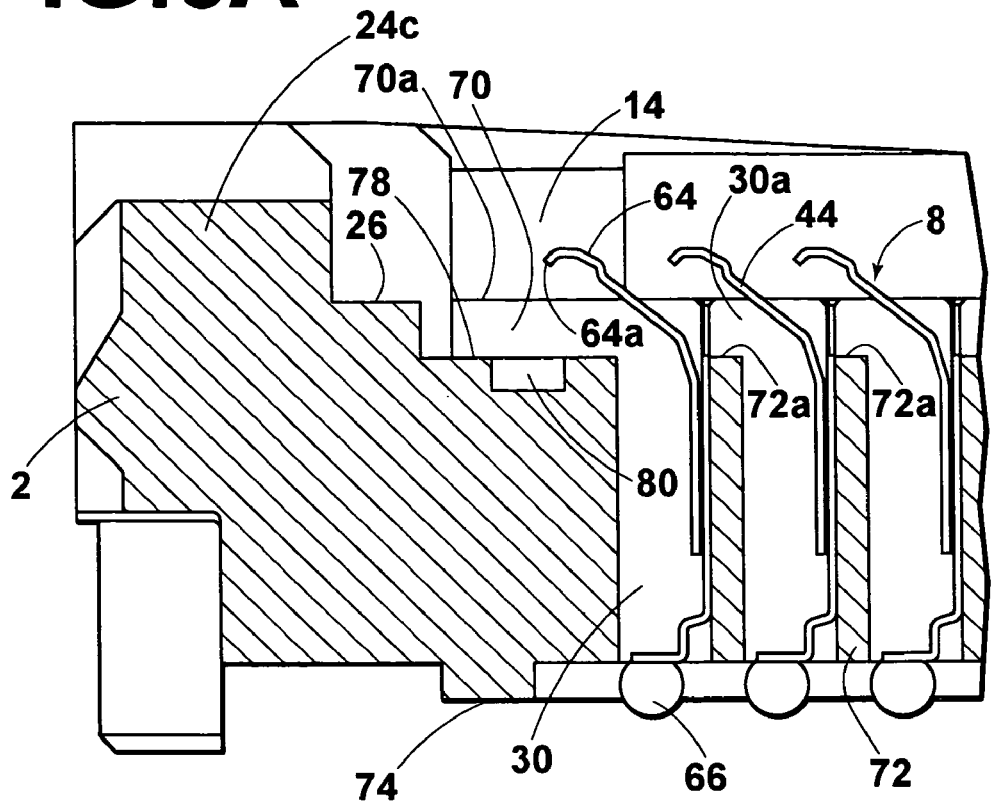
FIG. 6A is a partial sectional view of the insulative housing, in a state in which the contacts are installed in the insulative housing.

Installation of the contacts 8 into the housing 2 will now be described in detail with reference to FIGS. 6A, 6B, 7A, and 7B. As illustrated in FIG. 6A, a plurality of contact receiving cavities 30 pass through the housing 2 from the bottom surface 26 of the IC package receiving recess 14. The contact receiving cavities 30 are defined in a matrix arrangement by first partition walls 70 and second partition walls 72, which are perpendicular to each other.

When the contacts 8 are inserted into the contact receiving cavities 30, the bases 40 frictionally engage the inner walls of the contact receiving cavities 30, as described above, to secure the contacts 8 therein. The solder balls 66 on the terminal sections 48 slightly protrude from the bottom surface 74 of the housing 2. The free ends 64 of the contact arms 44 protrude above the bottom surface 26 of the IC package receiving recess 14. The top sections 70*a* of the first partition walls 70 are formed to be approximately the same height as the bottom surface 26. The top sections 70*a* may be set to be slightly lower than the bottom surface 26 to allow space for burrs that form during molding. The top sections 72*a* of the second partition walls 72 are formed to be shorter than or lower than the top sections 70*a* of the first partition walls 70.

Figure 6B:
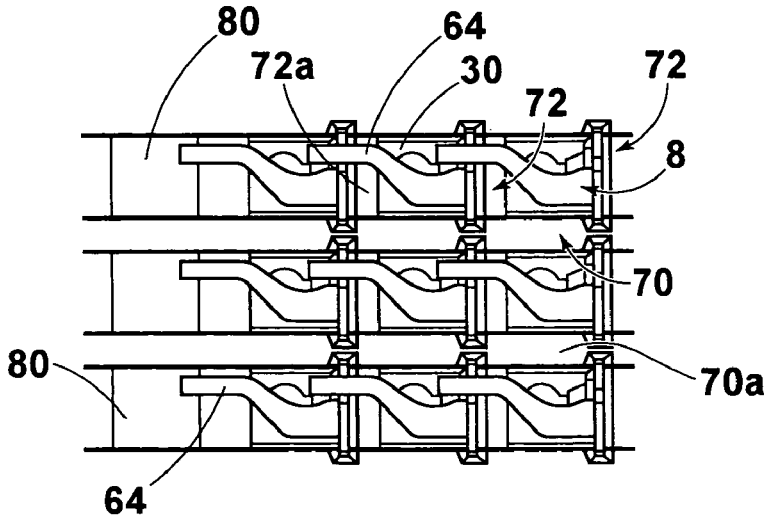
FIG. 6B is a partial plan view showing the arrangement of the contacts, in the state in which the contacts 8 are installed in the insulative housing.

Recesses 80 are formed in a step portion 78 between the first partition walls 70. The step portion 78 is of the same height as the top sections 72*a*. The recesses 80 are formed at positions and depths so that when the free ends 64 of the contacts 8 move downward, that is, flex, the foot 64*a* thereof does not strike the step 78 but instead is received in the recesses 80. FIGS. 6A and 6B clearly illustrate that the offset free ends 64 extend over and overlap respective adjacent contact receiving cavities 30. By this configuration, the contact arms 44 are sufficiently elastic and at the same time arranged in a high density arrangement. In addition, the free ends 64 do not interfere with the contact arms 44 of adjacent contacts 8, due to the configuration of the offset portion 62.

Figure 7A:
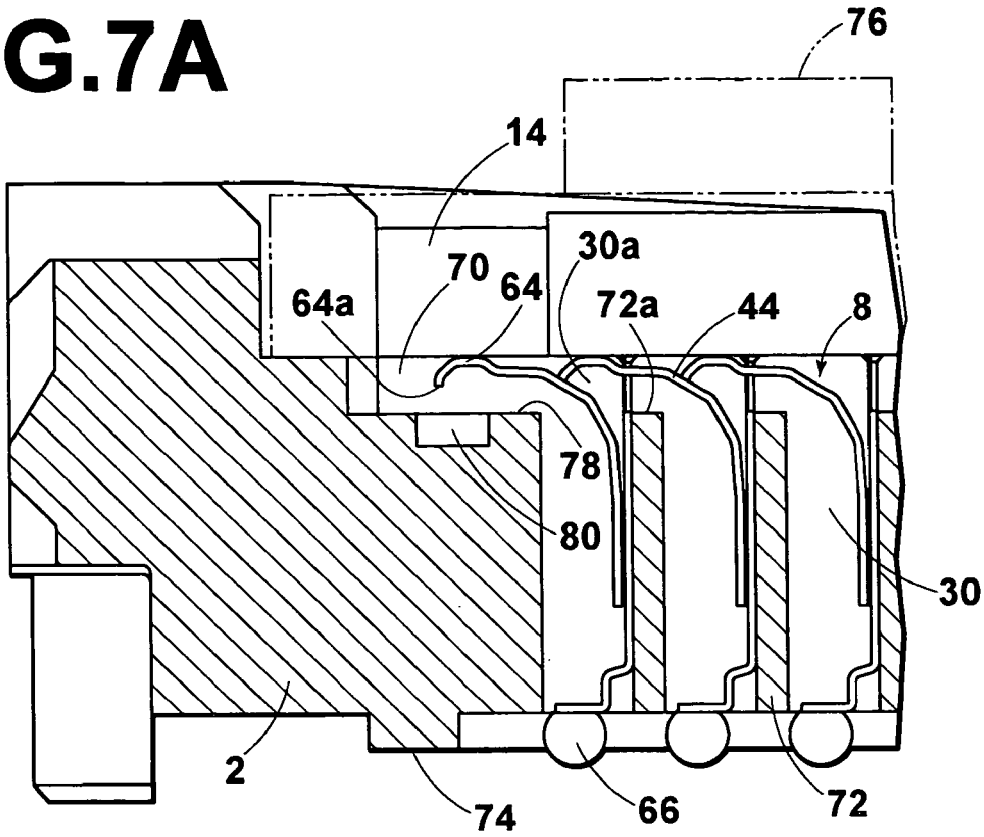
FIG. 7A is a partial sectional view of the insulative housing that illustrates the shapes of the contacts, in a state in which an IC package is mounted on the IC socket.
Figure 7B:
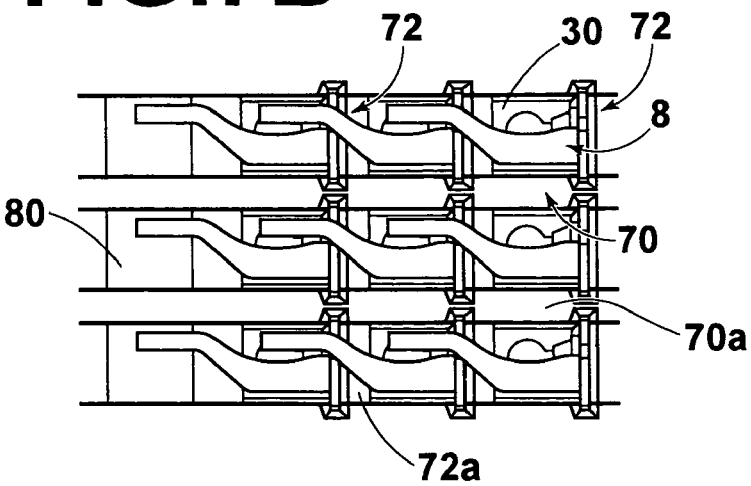
FIG. 7B corresponds to FIG. 6B, and is a partial plan view showing the arrangement of the contacts, in the state in which the IC package is mounted on the IC socket.

The IC socket 1 having the IC package 76 secured therein will be described with reference to FIG. 7A and FIG. 7B. Note that in the figures, the outline of the IC package 76 is illustrated by broken lines. The exemplary IC package 76 illustrated in FIG. 7A and FIG. 7B is of the LGA type. When the IC package 76 is mounted on the IC socket 1, the contact arms 44 flex downward against the lands (not shown) of the IC package 76. The contact arms 44 flex into spaces 30*a* of the contact receiving cavities 30, in which adjacent contacts 8 are installed, without interference with the second partition walls 72, which are of a relatively low height.

During mounting or dismounting of the IC package, a finger (not shown) may inadvertently touch or press the contact arms 44. However, downward movement of the finger is restricted by the first partition walls 70 thus preventing excessive force on the contact arms 44. The contact arms 44 remain within their ranges of elastic deformation as the finger contacts the first partition walls 70. Therefore, plastic deformation of the contact arms 44 is prevented.

As described above, the IC socket 1 of the present invention obtains the desired advantageous effects by the cooperative actions of the first and second partition walls 70 and 72, which define the contact receiving cavities 30 of the housing 2, and the shapes of the contacts 8. Accordingly, the present invention is not limited to the embodiment described above, and various modifications are possible as long as the shapes and the positional relationships are maintained. In addition, the IC package 76, which was utilized in illustrating the above embodiment was of the LGA type. However, a BGA type IC package may alternatively be accommodated. In the case that a BGA type IC package is utilized, the degree of flexure of the free ends 64 of the contacts 8 will increase. However, the flexure is accommodated by the spaces 30*a* of the contact receiving cavities 30, and the recesses 80.

In addition, the foot 64*a* of the contact arms 44 may extend further downward than those illustrated in FIGS. 6A, 6B, 7A, and 7B, as long as they are of lengths which can be accommodated within the contact receiving cavities 30 and the recesses 80. In this case, the risk of fingers and the like engaging the feet of the contact arms is further reduced. Therefore, deformation of the contacts can be further effectively prevented.

We claim:

1. An Integrated Circuit (IC) socket to be mounted on a circuit board, comprising:

an insulative housing, which has a plurality of cavities arranged in a matrix at an IC package receiving recess;

a plurality of electrical contacts, which are provided in the plurality of cavities; and a fixing mechanism for fixing an IC package in the IC package receiving recess; wherein each of the electrical contacts comprises: abase, which is installed within a cavity; a contact arm, which extends in a first direction from the upper side of the base; then in an offset direction from the first direction, then along the first direction in an offset manner above an adjacent cavity, for electrically contacting the IC package; and a terminal section, which is provided at the lower side of the base, for electrically connecting the electrical contact to the circuit board; and the insulative housing comprises: first partition walls, which are provided between rows of cavities adjacent to each other in the first direction; and second partition walls, which are provided between rows of cavities adjacent to each other in a second direction perpendicular to the first direction, the first partition walls having greater heights than those of the second partition walls.

2. An IC socket as defined in claim 1, wherein:

free ends of the contact arms extend downwardly in a protrusively curved manner; and the cavity, which is adjacent to the cavity in which the electrical contact is provided in the first direction, has space therein to accommodate the downward movement of the free end of the contact arm.

3. The IC socket as defined in claim 1 wherein each of the electrical contacts further comprises an extension portion extending in the first direction.

4. The IC socket as defined in claim 3 wherein each of the electrical contacts further comprises an offset portion which extends diagonally upward from the extension portion in the offset direction.

5. The IC socket as defined in claim 4 wherein each of the electrical contacts further comprises a bent back portion located between the base and the extension portion.

6. The IC socket as defined in claim 5 wherein each of the electrical contacts further comprises a free end extending downwardly in a protrusively curved matter.

7. The IC socket as defined in claim 6 wherein each of the electrical contacts further comprises a foot located at a terminal section extending from the base at an end opposite the free end.

8. The IC socket as defined in claim 6 wherein each of the electrical contacts further comprises barbs formed on side edges of the base.

9. The IC socket as defined in claim 8 wherein each of the electrical contacts further comprises cutouts formed in the side edges.

* * * * *

UNITED STATES PATENT AND TRADEMARK OFFICE

CERTIFICATE OF CORRECTION

PATENT NO. : 7,083,429 B2
APPLICATION NO. : 10/877402
DATED : August 1, 2006
INVENTOR(S) : Hashimoto et al.

It is certified that error appears in the above-identified patent and that said Letters Patent is hereby corrected as shown below:

In column 5, line 10 after comprises: delete “abase” and insert -- a base --

Signed and Sealed this

Tenth Day of October, 2006

JON W. DUDAS
*Director of the United States Patent and Trademark Office*